United States Patent [19]

Viesturs

[11] Patent Number: 4,517,693

[45] Date of Patent: May 21, 1985

[54] BODY SUPPORT APPARATUS

[75] Inventor: Eric A. Viesturs, Southbury, Conn.

[73] Assignee: Connecticut Artcraft Corporation, Naugatuck, Conn.

[21] Appl. No.: 581,918

[22] Filed: Feb. 21, 1984

[51] Int. Cl.[3] ..... A47C 27/08

[52] U.S. Cl. ..... 5/451; 5/455; 5/485; 5/411

[58] Field of Search ..... 5/425, 449, 450, 451, 5/452, 497, 498, 496, 485, 455, 411

[56] References Cited

U.S. PATENT DOCUMENTS

| | | | |
|---|---|---|---|
| 1,959,920 | 5/1934 | Kaiser | 5/498 |
| 3,419,920 | 1/1969 | Maddux et al. | 5/498 |
| 3,958,286 | 5/1976 | Rodinsky | 5/484 |
| 4,254,518 | 3/1981 | Buhren et al. | 5/455 |
| 4,267,611 | 5/1981 | Agulnick | 5/455 |
| 4,382,306 | 5/1983 | Lickert | 5/449 |

FOREIGN PATENT DOCUMENTS

| | | | |
|---|---|---|---|
| 8101792 | 7/1981 | PCT Int'l Appl. | 5/451 |

OTHER PUBLICATIONS

Ardo T. M., Flotation System–an article on p. 112 of the Jul. 1983 issue or "Flotation Sleep Industry' Magazine.

*Primary Examiner*—Alexander Grosz

[57] ABSTRACT

A body supporting structure is disposed upon the upper surface of a flat rectangularly shaped member which is adapted to be upon the top of a rectangularly shaped mattress in a hospital bed. The structure includes at least one hollow element rising above the upper surface and filled with air or water. A device secured to the lower surface of the member in a region intermediate the ends of the member but closer to one selected end of the member than to the other end includes a pocket which removably receives and encloses an end of the mattress adjacent the selected end of the member. The pocket holds the member in position and prevents the member from sliding downward toward the other end of the mattress when the adjacent mattress end is raised.

3 Claims, 5 Drawing Figures

BODY SUPPORT APPARATUS

BACKGROUND OF THE INVENTION

Bedridden patients who have to maintain a substantially motionless position for prolonged periods of time develop bedsores on the skin. These sores, referred to in medical terms as Decubitus Ulcers, are painful, hard to heal, and create conditions for further infection. Ulcer formations of this type are produced in most cases because the pressure exerted upon the skin surfaces under the bony prominences of the patient which bear most of the weight of the patient when the body of the patient presses against the ordinary mattress or other body support and obstructs the circulation of blood in the capillaries directly under these surfaces.

Certain types of body support devices which overlie the conventional mattress in a hospital bed have been constructed to minimize ulcer formation.

One such device is disclosed in copending application Ser. No. 295,504 filed 4/14/81 now U.S. Pat. No. 4,422,194 and assigned to the assignee of the present application. This device is a body support which can be filled with water or air. This support employs a first plastic section having oppositely disposed inner and outer surfaces. The outer surface is disposed above the inner surface and permanently defines a plurality of closely spaced raised regions of like size and contour which are interconnected by channels disposed below the walls of the regions. The inner surface of the first section permanently defines a like plurality of deep recesses, each deep recess constituting the inside of a corresponding region. The deep recesses are interconnected by shallow recesses, each shallow recess constituting the inside of a corresponding channel.

A second plastic section is sealed to the inner surface of the first section in a manner in which said deep and shallow recesses communicate with each other. A flexible hollow tube is disposed around the periphery of said sections and is secured thereto. The tube has an outer wall with openings which connect the tube interior to said shallow recesses. The tube and sections are sealed to each other in a leak-proof manner to prevent leakage of air or water between the interior of the tube and sections and the outside thereof.

This combination of tubes and sections thus has a hollow interior with deep and shallow recesses and tube interior being interconnected. In use, the interior is completely filled with water or air.

When a patient lies upon the device, the various raised regions conform independently without stretch tension to the body contour and, because of the intercommunicating hollow regions, the shallow channels and tube distribute the water or air as required. As the patient shifts in bodily position, the water or air movement adjusts the shape of the device accordingly.

The raised regions are depressed when conforming to the body contour and spread sideways to close the gaps therebetween, thus providing a continuous support between the spread regions and the body of the patient. Unlike the prior art devices, the top portions of the raised regions are not subjected to appreciable stretch-tension forces since the tube substantially eliminates sideways deformation of the raised regions which would otherwise produce such forces with the resultant adverse effects previously described. The use of the tube filled with water or air permits the raised regions that are not underneath the body to remain upright whereby the surface stretch in the rest of the raised regions under the body stretch-tension is minimized, and the pressure on the skin is also minimized, thus minimizing ulcer formation.

In another copending application, Ser. No. 06/543143 filed 10/18/83 and also assigned to the assignee of the present application, a similar tube and section structure is made even more effective in reducing ulcer formation by filling the central sections with water at the same time the peripheral tube is filled with air.

While the structures described above are very effective in minimizing ulcers, they are relatively heavy. When a patient lies on one of these structures which in turn overlies the mattress in a hospital bed and one end of the mattress is raised by operating the hospital bed mechanism the patient and the structure will slide downward toward the lower end of the mattress. This movement seriously impairs the effectiveness of the structure in minimizing ulcer formation and of course can cause the patient other discomfort.

The present invention eliminates such undesired downwardly sliding movement.

SUMMARY OF THE INVENTION

Body support apparatus in accordance with the principles of the present invention employs a flat rectangularly shaped member adapted to lie on top of a rectangular mattress in a hospital bed. A body supporting structure is secured to the upper surface of said member, said structure including at least one hollow element rising above said upper surface and filled with a fluid selected from the class of fluids which consists of air and water.

Means secured to the lower surface of said member in a region intermediate the ends of the member, but closer to one selected end of the member than to the other end, includes a pocket which removably receives and encloses an end of the mattress adjacent said selected end of the member to hold said member in position and prevent said member from sliding downward toward the other end of the mattress when said adjacent mattress is raised.

The means can include a second oppositely disposed pocket which removably receives and encloses the other end of the mattress whereby the downwardly sliding motion is elminated regardless of the relative positions of the ends of the mattress.

DETAILED DESCRIPTION OF PREFERRED EMBODIMENTS

Figure 1:
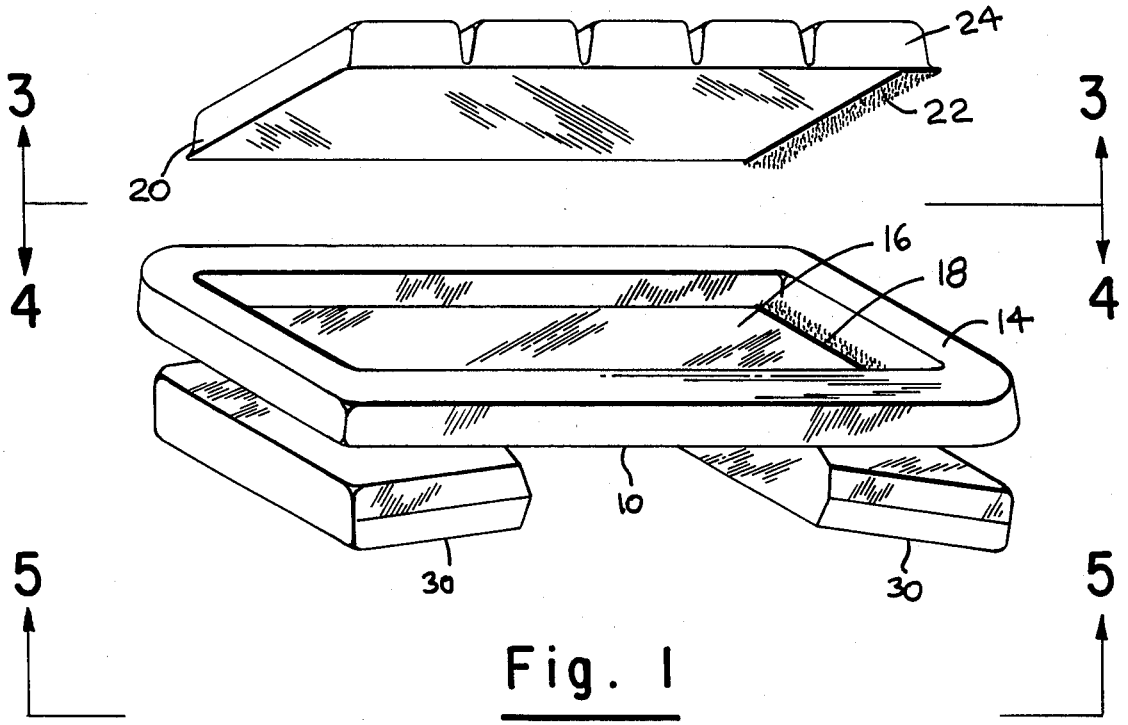
FIG. 1 is a perspective exploded view of one embodiment of the invention.
Figure 2:
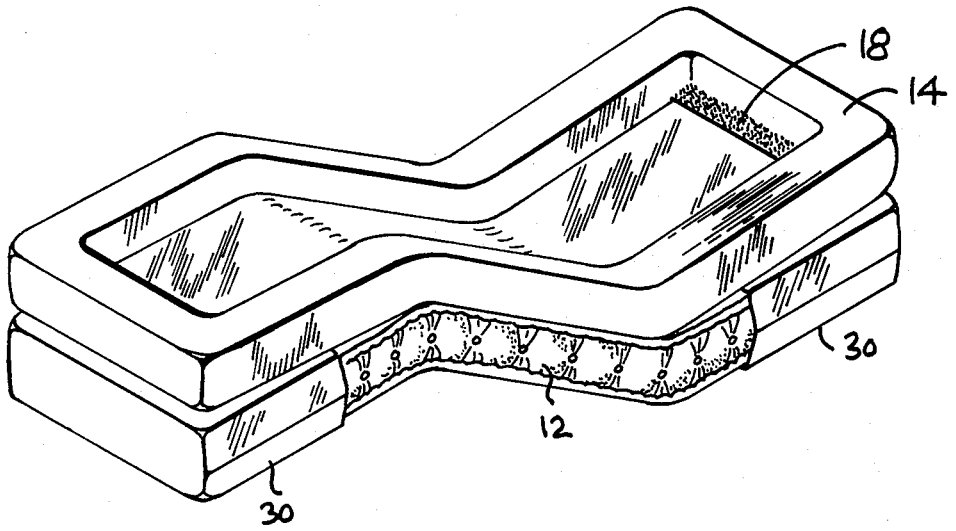
FIG. 2 is a perspective view illustrating use of the invention.
Figure 3:
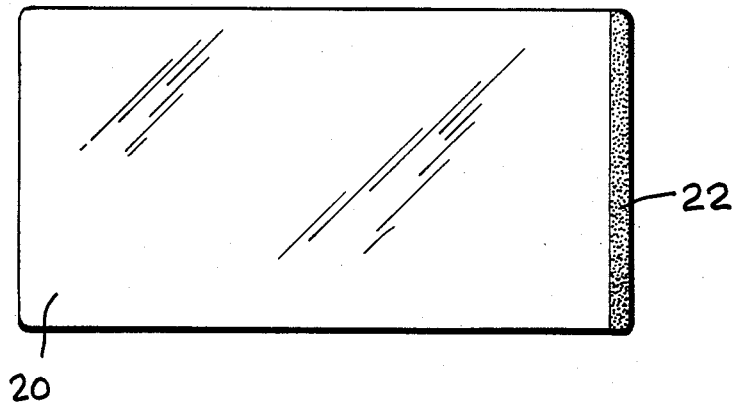
FIG. 3 is a view taken along line 3—3 in FIG. 1.
Figure 4:
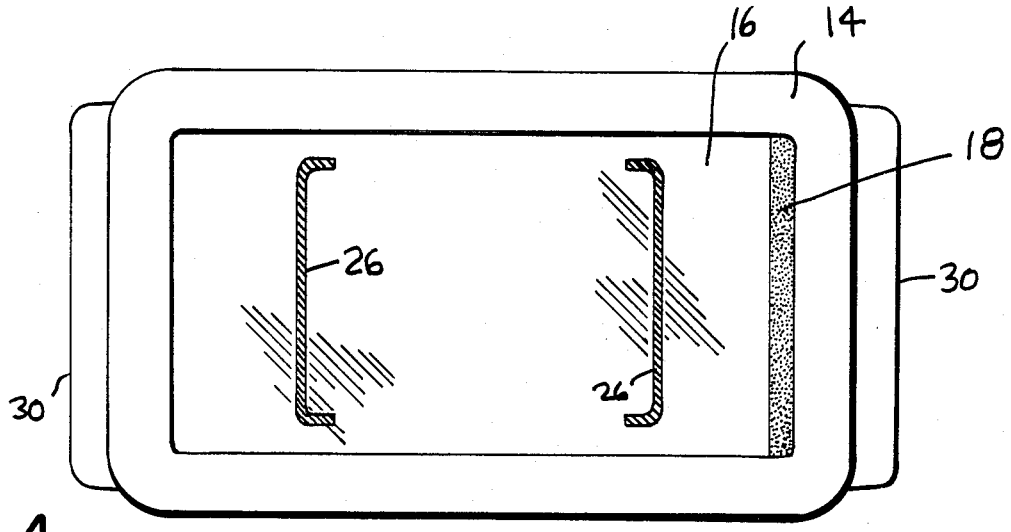
FIG. 4 is a view taken along line 4—4 in FIG. 1.
Figure 5:
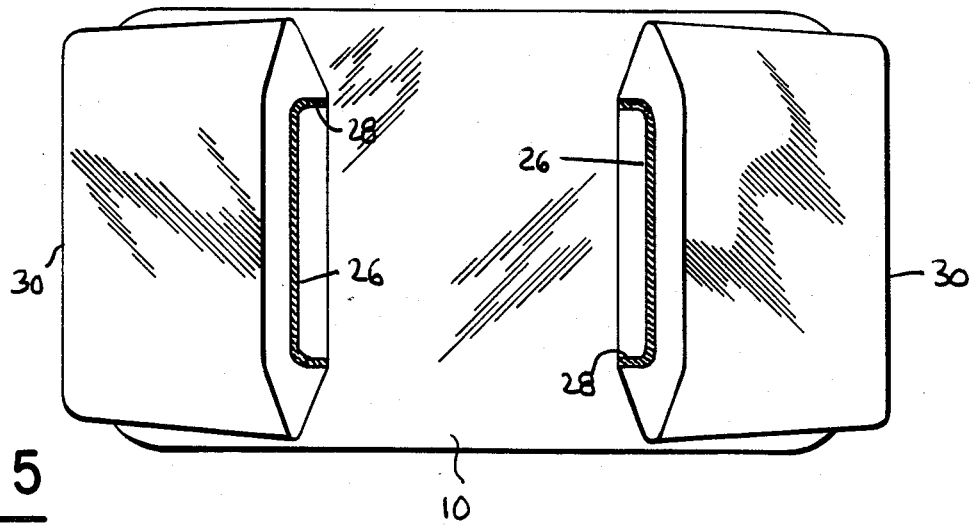
FIG. 5 is a view taken along line 5—5 in FIG. 1.

Referring now to FIGS. 1–5, a flat flexible plastic rectangularly shaped member 10 is adapted to overlie the mattress 12 of a conventional hospital bed (not shown). Secured to the top surface of member 10 is a peripherally disposed integral horizontal endless hollow tube 14 which can be inflated with air and when inflated defines a raised peripheral rectangular border surrounding and enclosing an inner flat horizontal centrally disposed rectangular area 16. One or both ends of area 16 can carry a hook and loop type fastener or similar strip 18 which is secured thereto.

A second plastic unit 20 is rectangular in shape and is adapted to be removably disposed on area 16. Unit 20 has a flat bottom surface carrying on one end another hook and loop type fastener or similar strip 22 adapted for detachable mating engagement with strip 18.

Unit 20 contains a plurality of spaced apart raised enlarged rectangular elements 24 which are filled with water and which are interconnected by lower water filled elongated channels or tubes.

Alternatively, unit 20 can be integral with tube 14 and member 10 and the tube and elements can all be filled with water or all filled with air.

Secured to the bottom surface of member 10 are two oppositely directed plastic flexible pockets 30. Each pocket is sealed to the bottom surface along a C shaped line of seal 26 which is elongated in the transverse dimension of the member extending over almost the entire width. This line of seal is strong enough to maintain the pocket securely joined to the member and is narrow enough to permit the pocket to be flexible and easy to fit about the corresponding end of mattress 12 to removably receive and enclose this end. The downward sliding movement is thus eliminated as previously described.

Each line of seal is disposed intermediate the transverse center line of member 10 and a corresponding end of the member, typically being located half way therebetween or at one third of the longitudinal distance between the center line and the corresponding end as measured from the center line.

Each pocket extends in width along the entire width of the member 10 and extends in length from the edges of the short longitudinally extending legs 28 of the line of seal to the corresponding end of the member. In other words each pocket extends longitudinally across approximately one quarter to one third of the entire length of member 10.

What is claimed is:

1. Body support apparatus comprising:

a flat rectangularly shaped member adapted to be on top of a rectangular mattress in a hospital bed;

a body supporting structure on the upper surface of said member, said structure including at least one hollow element rising above said upper surface and filled with a fluid selected from the class of fluids which consists of air and water; and a separate flexible pocket disposed below the lower surface of said member adjacent one selected end thereof for removably receiving and enclosing an end of the mattress adjacent said selected end, said pocket being secured to said lower surface by a line of seal which is narrow to permit the pocket to be flexible and easy to fit, said line being elongated in the transverse direction of said member and extending over almost the entire width, each end of said line terminating in a short leg which extends longitudinally along said member away from said selected end, said line being disposed intermediate the transverse center line of said member and said selected end, said pocket extending in width along the entire width of said member and extending in length from the free ends of said legs to the selected end of said member whereby said pocket holds the member in position and prevents said member from sliding downward toward the other end of the mattress when the adjacent mattress end is raised.

2. The body support apparatus of claim 1 further including another like pocket disposed below the lower surface of said member adjacent the other end thereof, said another pocket being secured to another like and parallel line of seal, each end of said another line terminating in another like leg which extends longitudinally along said member towards said selected end, said another line being disposed intermediate the transverse center line of said member and said other end, said another pocket extending in width along the entire width of said member and extending in length from the free ends of said another legs to the other end of the member.

3. Apparatus as set forth in claim 2 wherein each pocket extends longitudinally across between one quarter and one third of the entire length of the lower surface of the member.

* * * * *